US006008568A

United States Patent [19]

Pitel et al.

[11] Patent Number: 6,008,568

[45] Date of Patent: Dec. 28, 1999

[54] HEATSINKED LAMP ASSEMBLY

[75] Inventors: Ira J. Pitel, Morristown, N.J.; Benjamin J. Slootskin, Stamford, Conn.

[73] Assignee: Dymax Corporation, Torrington, Conn.

[21] Appl. No.: 09/041,920

[22] Filed: Mar. 13, 1998

[51] Int. Cl.[6] ..... H01J 7/24; H01J 61/52

[52] U.S. Cl. ..... 313/46; 313/43; 313/45; 313/113; 362/345; 439/487

[58] Field of Search ..... 313/43, 45, 46, 313/113; 362/285, 296, 294, 345; 439/487

[56] References Cited

U.S. PATENT DOCUMENTS

| | | | |
|---|---|---|---|
| 1,510,344 | 9/1924 | Reinker | 362/285 |
| 3,541,492 | 11/1970 | Fenn | 439/239 |
| 3,648,045 | 3/1972 | Le Vantine et al. | 362/265 |
| 3,906,217 | 9/1975 | Lackore | 362/396 |
| 4,163,277 | 7/1979 | Altman | 362/296 |
| 4,935,633 | 6/1990 | Curbelo et al. | 250/504 R |
| 5,207,505 | 5/1993 | Naraki et al. | 362/294 |
| 5,387,800 | 2/1995 | Kurtich et al. | 250/504 R |
| 5,442,252 | 8/1995 | Golz | 313/111 |
| 5,621,267 | 4/1997 | Shaffner et al. | 313/113 |

*Primary Examiner*—Michael Day
*Attorney, Agent, or Firm*—Ira S. Dorman

[57] ABSTRACT

A reflector/lamp assembly employs a heat-sink component that includes a rigid, elongate, relatively wide and thin conductor element which is disposed forwardly of the reflector rim and extends radially to a distal point lying substantially beyond the axial projection of the rim. The heat-sink component efficiently dissipates thermal energy without attenuating the reflected radiation and without imposing physical constraints or stresses.

9 Claims, 2 Drawing Sheets

HEATSINKED LAMP ASSEMBLY

BACKGROUND OF THE INVENTION

Elongate arc lamps mounted in reflectors are extensively used for a wide range of purposes. One typical application is to generate ultraviolet radiation (or radiation of other wave-lengths) used for example for effecting curing of photoinitiated adhesives and coating compositions.

For optimal performance, efficiency, longevity, and economy, it is important that the large quantities of heat generated by such lamps be dissipated effectively, and that such dissipation occur without significant attenuation of the radiant energy delivered by the device. Although there are commercially available lamp/reflector assemblies that are entirely satisfactory in most respects, improvements of the heat-dissipation effectiveness of any such unit would generally be regarded as highly desirable.

Exemplary of the prior art on reflector assemblies, and similar units, are the following U.S. patents:

Reinker U.S. Pat. No. 1,510,344 and Lackore U.S. Pat. No. 3,906,217 disclose mounting brackets for lamps wherein the contact elements appear to be of thin, relatively wide metal construction. Fenn U.S. Pat. No. 3,541,492 provides opposing, spring-loaded pivoted arms to engage a tubular electric Lamp and to act as heat sinks. The radiating element of the infrared source assembly employed in Curbelo et al. U.S. Pat. No. 4,935,633 may be welded to a post conductor 45, and Golz U.S. Pat. No. 5,442,252 provides an L-shaped support rod 38.

In U.S. Pat. No. 3,648,045, Le Vantine et al. provide a lantern that employs a discharge lamp of elongate form, coaxially assembled in a reflector. The mounting means for the forward end of the lamp includes legs which appear to be made from thin, relatively wide strips and to serve an electrical function.

Naraki et al. U.S. Pat. No. 5,207,505 discloses holding an upper mouth piece of a lamp in suspension by a leaf spring, which also serves as a lead wire. The lamp is coaxially disposed in the elliptic mirror provided.

A prefocused lamp and reflector assembly, comprising an elongated lamp having opposite end portions that extend through aligned openings in the wall that defines the reflective cavity, is provided by Kurtich et al. U.S. Pat. No. 5,387,000.

Shaffner et al. U.S. Pat. No. 5,621,267 describes, with reference to the prior art, a lamp that includes a reflector with which a bulb is assembled in a coaxial relationship. The electrode shaft at one end of the bulb is cemented to a ceramic base, and the opposite electrode shaft is attached to the edge of the reflector by a pair of copper strips, which strips provide one terminal for a power supply and serve as cooling fins. The lamp system of the Shaffner et al. invention employs a metal cooling fin that is in electrical connection with one end of the bulb and that acts as a strut, from an edge of the reflector body, to provide mechanical support.

SUMMARY OF THE INVENTION

Despite the existing prior art, a need remains for a novel lamp assembly in which heat generated by the lamp is dissipated with improved efficiency and without significant attenuation of radiation emitted by the lamp and reflected by the reflector. It is therefore the broad object of the present invention to provide a novel lamp assembly that satisfies the foregoing need.

Related objects of the invention are to provide a lamp assembly having the indicated features and advantages, in which the lamp is fixedly and securely mounted in the reflector, in which the heat-dissipating means imposes no physical constraints upon the assembly, and which is incomplex and convenient to install and relatively facile and inexpensive to produce.

It has now been found that the foregoing and related objects of the invention are readily attained by the provision of a lamp assembly comprising a reflector, an elongate lamp assembled with the reflector, and a heat-sink component. The reflector of the assembly includes forward wall structure, terminating at a forward rim and defining a forwardly directed reflective cavity with a central axis, and rearward wall structure extending rearwardly from the forward wall structure and defining about the central axis of the reflector an enclosure in communication with the reflective cavity. The lamp has opposite end portions with electrical contacts thereon, and an element between the end portions for emitting radiation. The lamp is disposed with its longitudinal axis substantially coaxial with the central axis of the reflector, and with one of its end portions at least partially contained within the enclosure defined by the rearward wall structure. Means is provided for rigidly securing the "one" end portion of the lamp within the enclosure, and the electrical contact on the other end portion of the lamp is electrically and physically attached to means on the heat-sink component. The heat-sink component also includes a rigid, elongate, relatively wide and thin conductor element made of electrically and thermally conductive material, which element is disposed forwardly of the reflector rim and is preferably at least substantially free from attachment to the reflector. The conductor element is oriented with its length extending in a generally radial direction, from a point proximate the central axis of the reflector to a distal point lying substantially beyond the axial projection of its rim, and with its width and thickness dimensions substantially parallel and perpendicular, respectively, to the central axis. The conductor element thus serves to efficiently dissipate thermal energy generated by the lamp while, at the same time, presenting no structure that would significantly block radiation emitted by the lamp and reflected by the reflector.

The forward rim of the reflector will usually lie substantially on a plane, beyond which plane the conductor element of the heat-sink component will preferably be at least substantially disposed; the associated electrical contact on the end portion of the lamp will also desirably lie forwardly of the same plane. In particularly preferred embodiments, the conductor element will extend fully from the central axis of the reflector and it will have a distal portion lying beyond the axial projection of the reflector rim, that portion constituting at least about 15 percent of the length of the conductor element, as measured from the central axis. The conductor element will also desirably be of substantially L-shaped configuration, comprised of a long rectilinear leg, extending between the central axis of the reflector and the distal point, and a short leg extending generally perpendicularly to the long leg at the distal end thereof; it will generally be fabricated from a long strip of thin metal, of uniform width along its length. The means provided for attaching the heat sink component will preferably permit free rotation of the component about the longitudinal axis of the lamp. The means for securing the lamp in the reflector will advantageously comprise a hardened mass of potting compound contained in the rearward enclosure of the reflector, in which mass the end portion of the lamp is embedded.

DETAILED DESCRIPTION OF THE PREFERRED AND ILLUSTRATED EMBODIMENT

Figure 1:
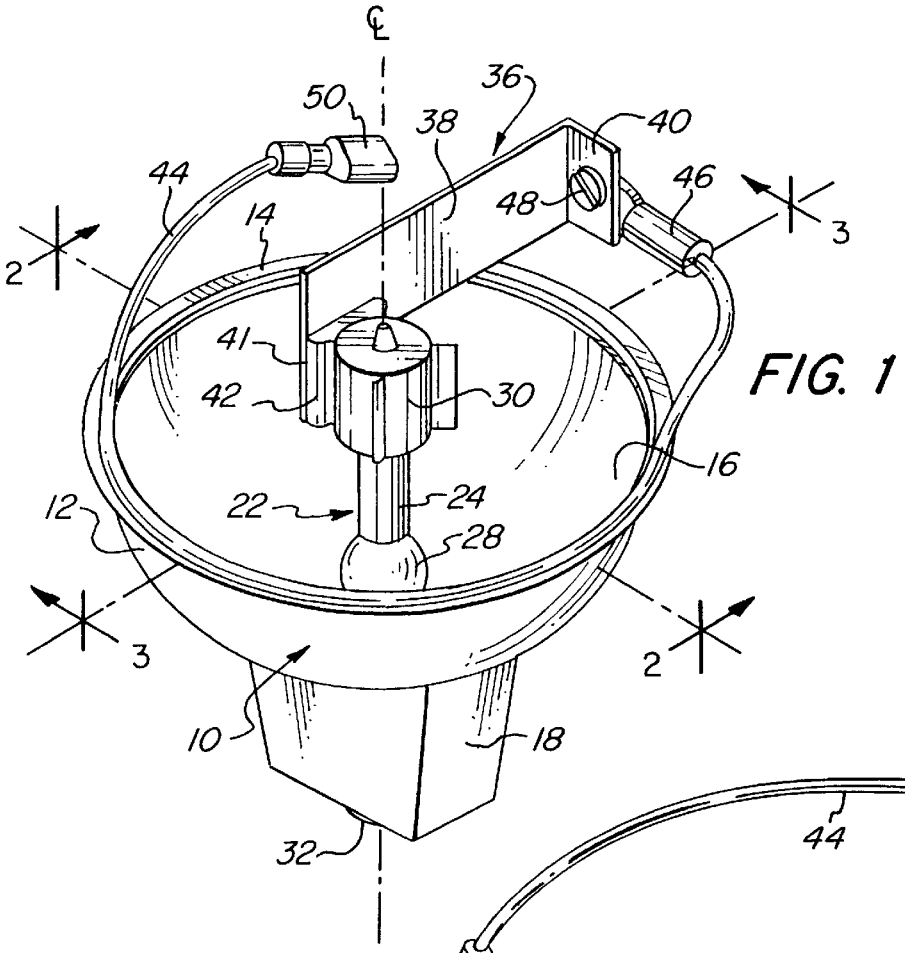
FIG. 1 is an isometric view of an assembly embodying the present invention.
Figure 2:
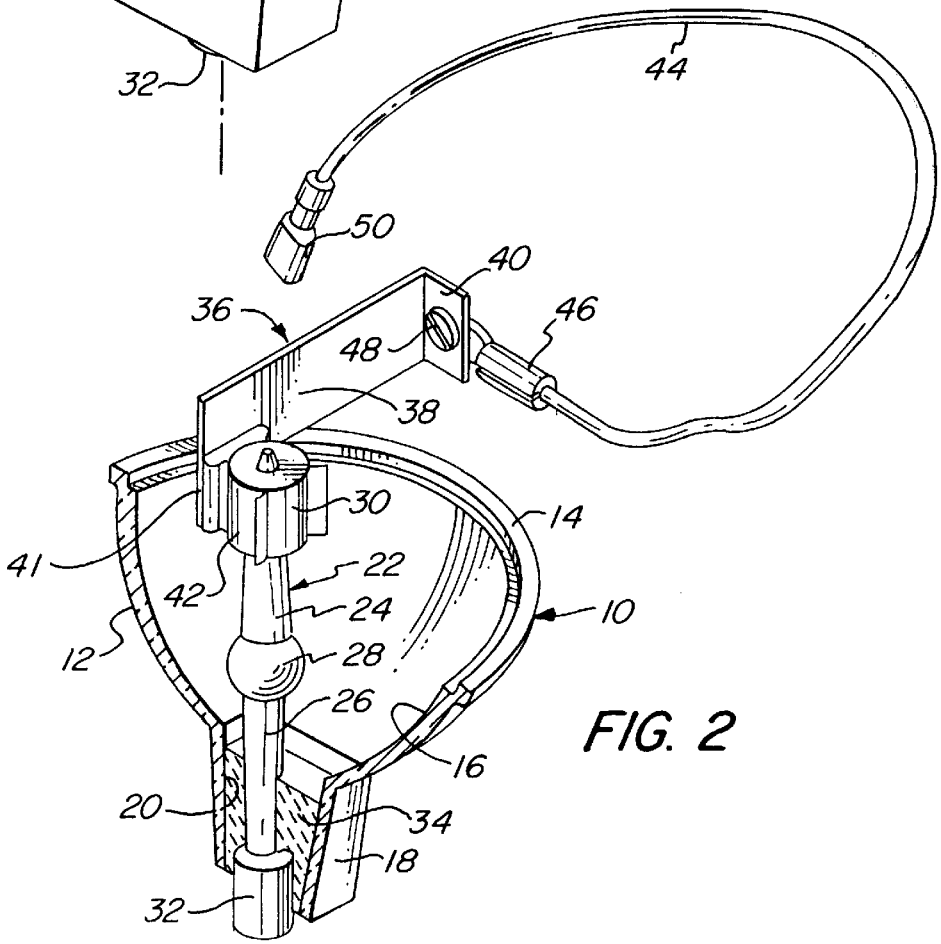
FIG. 2 is a fragmentary isometric view of the assembly, taken along line 2—2 of FIG. 1.

The illustrated lamp assembly includes a one-piece reflector, generally designated by the numeral 10. Forward wall structure 12 of the reflector 10 terminates at a rim 14, lying on a plane designated X (see FIG. 3), and defines a reflective cavity 16; rearward wall structure 18 defines an enclosure 20, in direct communication with the reflective cavity 16.

An arc lamp, generally designated by the numeral 22, includes an elongate glass envelope having opposite end portions, 24 and 26, and a bulbous intermediate portion 28 within which the radiation-emitting element (not seen) is located. The radiation-emitting element is connected by conductive elements (also not seen) to the metal contact terminals 30, 32 on the end portions 24, 26, respectively, to permit operative electrical contact for supplying power (from a source not shown) to the lamp 22. The lamp 22 is disposed with its longitudinal axis on the centerline axis of the reflector 10, and with the end portion 26, and its associated terminal element 32, embedded in a mass of potting compound 34 that completely fills the space within the enclosure 20. A portion of the terminal element 32 protrudes beyond the mass 34 for connection to the power supply provided.

A heat-sink component, generally designated by the numeral 36, is comprised of an L-shaped element, made from a strip of metal formed to have a relatively long leg 38 and a relatively short leg 40, the latter extending at a right angle from the distal end of the leg 38; the proximal end of the leg 38 is configured to provide an integral coplanar tab element 41 (only the edge of which is seen). A clip 42, formed from spring steel or like material, is fastened upon the tab element 41 and the adjacent area of the leg 38 (as by a nut and a screw), and serves to frictionally engage the terminal 30 on the end portion 24 of lamp 22. An insulated wire 44 has an eyelet terminal 46 attached to one end, which is in turn secured in electrical contact with the leg 40 of the component 36 by a screw 48 and cooperating nut 49. A connector 50, such as for engagement with a blade or other form of contact on the power supply, is secured to the free end of the wire 44. (It might be mentioned that, as depicted in FIG. 1, the wire 44 is stored to facilitate convenient packaging of the unit.)

As will be appreciated, power for illuminating the lamp 24 is conducted through the heat-sink component 36. It will also be appreciated that heat generated by the lamp will be transferred to the component 36, primarily by conduction, for radiation and dissipation. A high level of efficiency of thermal energy dissipation is particularly important in a lamp assembly of the kind to which the present invention is directed, wherein the potting compound 34 closes the rearward end of the reflector to the flow of air and thus inhibits convection cooling.

Figure 3:
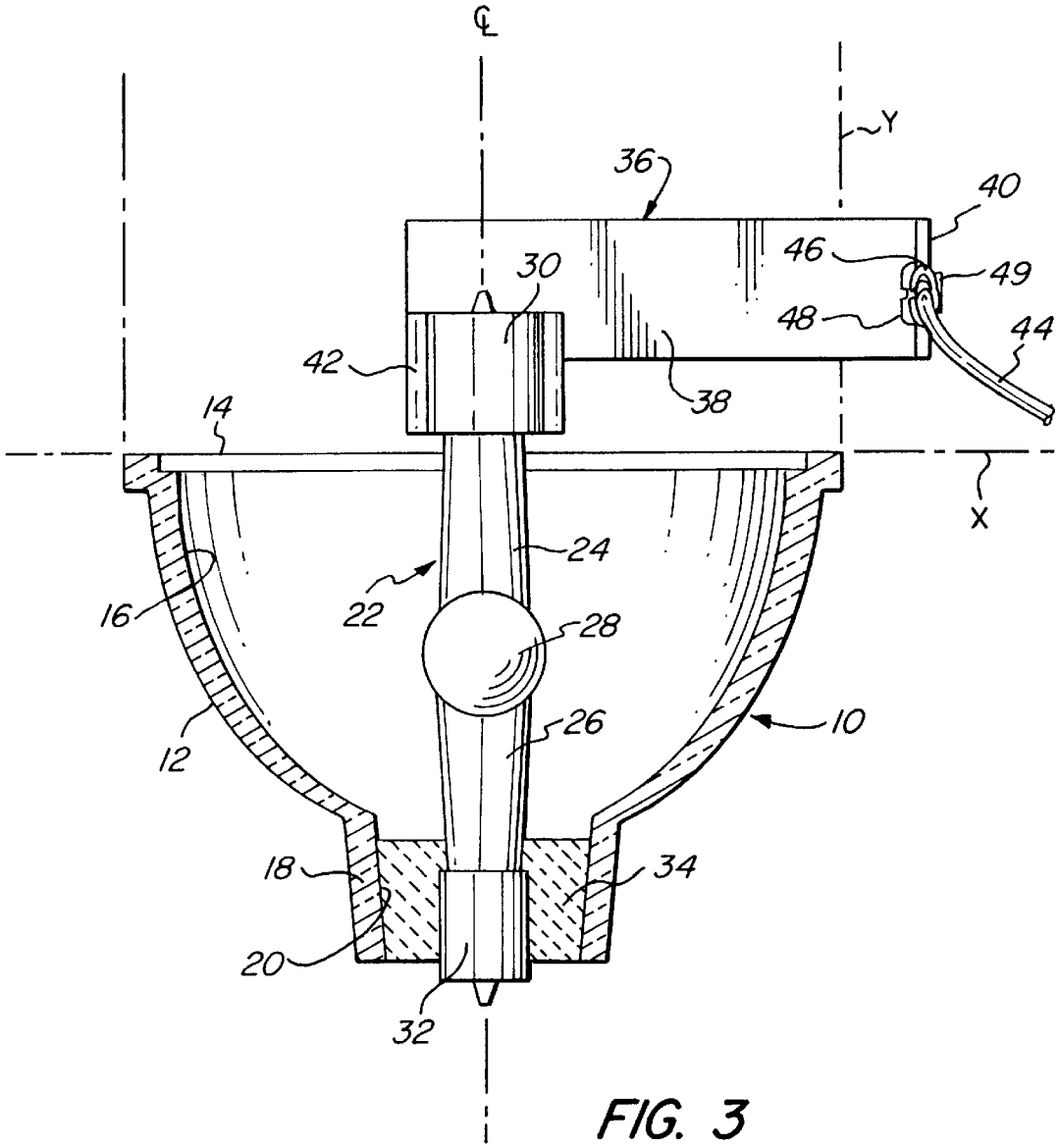
FIG. 3 is sectional view of the assembly taken along line 3—3 of FIG. 1.

Efficient thermal energy dissipation is promoted both by the position of the component 36, relative to the reflector 10, and also by the construction of the component itself. As is best shown in FIG. 3, the component 36 (as well as the forward-most terminal 30 of the lamp 22), is disposed entirely forwardly of the plane X in which the rim 14 of the reflector 10 lies. Moreover, a portion of the longer leg 38 (and of course the shorter leg 40 on its distal end) lies substantially beyond the axial projection Y of the rim 14. Both of these features maximize exposure of the component 36 to the flow of ambient air, thereby promoting efficient thermal energy transfer and removal of heat from the site. Ideally, for that purpose, at least about 15 percent of the length of the longer leg 38 (as measured between the longitudinal axis of the bulb and the distal end of the leg) will lie radially beyond the rim 14, consistent of course with space and structural constraints and perhaps other practical factors as well. Because moreover the metal strip of which the component 36 is constructed is oriented with its thin edge facing the reflector (i.e., with its width dimension extending parallel to the axis of the bulb and with its thickness dimension perpendicular thereto), the heat-sink component blocks very little of the reflected radiation generated by the bulb, and thus causes no significant attenuation thereof.

In practice, lamp 22 will typically be a 50-Watt mercury vapor lamp, and the reflector will typically be made of optically coated glass and will have an elliptical reflective cavity. The metal from which the L-shaped member of the heat-sink component is fabricated will usually be copper or aluminum, and the potting compound with which the enclosure of the rearward wall structure is filled will generally be a ceramic.

The spring clip 42, by which the component 36 is attached to the lamp 22, permits free rotation of the component about the lamp axis. This feature not only contributes to the ease and convenience with which electrical and physical connections can be made, but ii: also avoids any mechanical constraint upon the lamp. Since the component 36 is attached only to the lamp, moreover, no thermal or physical stresses are imposed by the lamp upon the reflector, or vice versa (as might lead to premature failure). This is particularly important in a unit of the kind described, wherein high levels of thermal stress are generated during normal operation and cycling. The lamp envelope typically attains a temperature of 650° C. to 700° C., whereas the temperature at the ends of the lamp should not be permitted to exceed about 250° and the temperature differential should be kept to a minimum.

Thus, it can be seen that the present invention provides a novel lamp assembly in which heat generated is efficiently dissipated without significant attenuation of the reflected radiation. The lamp is fixedly and securely mounted in the reflector, and the heat-dissipating means imposes no physical constraints upon the assembly; the assembly is incomplex and convenient to install, and is relatively facile and inexpensive to produce.

Having thus described the invention, what is claimed is:

1. A lamp assembly, comprising:

a reflector comprised of forward wall structure terminating at a forward rim and defining a forwardly directed reflective cavity with a central axis, and rearward wall structure extending rearwardly from said forward wall structure and defining about said central axis an enclosure in communication with said reflective cavity;

an elongate lamp having opposite end portions with electrical contacts thereon, and an element between said end portions for emitting radiation, said lamp being disposed with its longitudinal axis substantially coaxial with said central axis of said reflector, and with one of said end portions of said lamp at least partially contained within said reflector enclosure;

means for rigidly securing said one end portion of said lamp within said reflector enclosure; and a heat-sink component including means for electrically and physically attaching said component to said electrical contact on the other end portion of said lamp, said heat-sink component including a rigid, elongate, relatively wide and thin conductor element made of electrically and thermally conductive material, said conductor element being disposed forwardly of said reflector rim and being oriented with its length extending in a generally radial direction from a point proximate said central axis to a distal point lying substantially beyond the axial projection of said rim, and with its width and thickness dimensions substantially parallel and perpendicular, respectively, to said central axis, said conductor element thereby serving to efficiently dissipate thermal energy generated by said lamp without blocking significantly radiation emitted thereby and reflected by said reflector.

2. The lamp assembly of claim 1 wherein said forward rim of said forward wall structure lies substantially on a plane, and wherein said conductor element of said heat-sink component is disposed substantially in its entirety forwardly of said plane on which said rim lies.

3. The lamp assembly of claim 2 wherein said electrical contact on said other end portion of said lamp is also disposed forwardly of said plane.

4. The lamp assembly of claim 1 wherein a distal portion of said conductor lies beyond the axial projection of said rim, said distal portion constituting at least about 15 percent of the length of said conductor element, as measured from said central axis.

5. The assembly of claim 4 wherein said conductor element is substantially L-shaped and is comprised of a relatively long rectilinear leg, extending between said central axis and said point beyond said rim, and a relatively short leg extending generally perpendicularly to said long leg at the distal end thereof, said distal portion being a portion of said long leg; and wherein said heat sink component further includes means for operative electrical connection of said short leg of said conductor element to a power supply.

6. The assembly of claim 5 wherein said conductor element extends from said central axis and is fabricated from a long strip of thin metal which is of uniform width along its length.

7. The assembly of claim 1 wherein said means for attaching said heat sink component permits free rotation of said component on said lamp about said longitudinal axis, said heat sink component being entirely free from attachment to said reflector.

8. The assembly of claim 1 wherein said means for securing, together with said one end portion of said lamp, spans said enclosure and prevents air flow therethrough from said reflective cavity.

9. The assembly of claim 8 wherein said means for securing comprises a hardened mass of potting compound in which said one end portion of said lamp is embedded, said electrical contact on said one end portion of said lamp being accessible for operative elcetrical connection to a power supply from outside said reflector.

* * * * *